US007411563B2

(12) United States Patent
Liu et al.

(10) Patent No.: US 7,411,563 B2
(45) **Date of Patent: *Aug. 12, 2008**

(54) ANTENNA DEVICE

(75) Inventors: Kuo-Cheng Liu, Xindian (TW); Chin-Hon Fan, Xindian (TW); Kun-Ting Lin, Xindian (TW); Ren-Peng Chen, Xindian (TW)

(73) Assignee: High Tech Computer, Corp., Taoyuan (TW)

( * ) Notice: Subject to any disclaimer, the term of this patent is extended or adjusted under 35 U.S.C. 154(b) by 0 days.

This patent is subject to a terminal disclaimer.

(21) Appl. No.: 11/826,763

(22) Filed: Jul. 18, 2007

(65) Prior Publication Data

US 2007/0262915 A1 Nov. 15, 2007

Related U.S. Application Data

(63) Continuation of application No. 11/099,616, filed on Apr. 6, 2005, now Pat. No. 7,253,787.

(30) Foreign Application Priority Data

Nov. 25, 2004 (TW) ..... 93136269 A
Dec. 17, 2004 (CN) ..... 2004 1 0102062 A

(51) Int. Cl.
*H01Q 1/36* (2006.01)

(52) U.S. Cl. ..... 343/895

(58) Field of Classification Search ..... 343/700 MS, 343/725, 829, 846, 853, 895
See application file for complete search history.

(56) References Cited

U.S. PATENT DOCUMENTS

| | | | | |
|---|---|---|---|---|
| 5,828,348 | A | 10/1998 | Tassoudji et al. | |
| 5,986,616 | A * | 11/1999 | Edvardsson | 343/853 |
| 6,184,844 | B1 | 2/2001 | Filipovic et al. | |
| 6,184,845 | B1 | 2/2001 | Leisten et al. | |
| 6,886,237 | B2 * | 5/2005 | Leisten et al. | 29/600 |
| 7,253,787 | B2 * | 8/2007 | Liu et al. | 343/895 |
| 2002/0140622 | A1 | 10/2002 | Park et al. | |

FOREIGN PATENT DOCUMENTS

| | | | |
|---|---|---|---|
| EP | 0 791 978 | A | 8/1997 |
| JP | 1-132107 | U | 9/1989 |
| JP | 5-14043 | A | 1/1993 |
| JP | 06 077722 | A | 3/1994 |
| JP | 08 078945 | A | 3/1996 |
| JP | 2001-168631 | A | 6/2001 |
| WO | WO-98/44590 | A | 10/1998 |

* cited by examiner

*Primary Examiner*—Shih-Chao Chen
(74) *Attorney, Agent, or Firm*—Birch, Stewart, Kolasch & Birch, LLP

(57) ABSTRACT

An antenna device has a dielectric body with a convex surface and a concave surface. The antenna device further has a flexible printed circuit board disposed on the convex surface.

16 Claims, 4 Drawing Sheets

ANTENNA DEVICE

This application is a Continuation of application Ser. No. 11/099,616 filed on Apr. 4, 2005 now U.S. Pat. No. 7,251,787 and for which priority is claimed under 35 U.S.C. § 120, which claims priority of Application No. 93136269 filed in Taiwan on Nov. 25, 2004 under 35 U.S.C. § 119, the entire contents of which are hereby incorporated by reference.

BACKGROUND OF THE INVENTION

1. Field of the Invention

The invention relates to a helix antenna, and in particular to a helix antenna with reduced manufacturing costs.

2. Brief Description of the Related Art

Japan Patent. No. 2001-168631 discloses a conventional method for manufacturing a helix antenna providing a frequency of circularly polarized radiation exceeding 200 MHz. As shown in FIG. 1A, a metal (copper) layer 2 is coated (electroplated) on the outer surface of a solid ceramic cylinder 1 in which a central through hole 3 is formed. The metal (copper) layer 2 of the solid ceramic cylinder 1 is etched by a laser etching system (not shown), thereby providing a specific profile as shown in FIG. 1B. As shown in FIG. 1C, a coaxial cable 4 with an exposed copper core 41 is disposed in the central through hole 3 of the solid ceramic cylinder 1. The copper core 41 is then bent and welded to the metal (copper) layer 2 on the top of the solid ceramic cylinder 1, thereby achieving electrical connection between the coaxial cable 4 and the metal (copper) layer 2. At this point, the copper core 41 serves as a feeder. Accordingly, as the solid ceramic cylinder 1 is three-dimensional, the metal (copper) layer 2 cannot be precisely etched to form the specific profile by the laser etching system. Thus, some parameters, such as radio frequency (RF) and impedance matching, of the helix antenna cannot be obtained as required. A test and adjustment device (not shown) must then be applied to fine tune the parameters of the helix antenna.

The following description is directed to the steps of fine tuning the parameters of the helix antenna.

The helix antenna shown in FIG. 1C is connected to the test and adjustment device. Multiple probes of the test and adjustment device are coupled to the helix antenna, detecting magnitude of relative phases and amplitude of electric currents in some specific positions of the helix antenna. According to the detection of the probes, the laser etching system etches the metal (copper) layer 2 on the top of the solid ceramic cylinder 1, forming a plurality of openings 21, as shown in FIG. 1D. Specifically, to fine tune inductance of the helix antenna, the positions, profiles, and sizes of the openings 21 must be carefully arranged, thereby providing the helix antenna with a frequency of circularly polarized radiation exceeding 200 MHz.

A few drawbacks, however, exist in the process of manufacturing the aforementioned helix antenna. Bending and welding the copper core 41 to the metal (copper) layer 2 on the top of the solid ceramic cylinder 1 increases manufacturing time and causes inconvenience. Moreover, the laser etching system is very expensive and laser heads thereof must be replaced after 1500 hours, thereby increasing manufacturing costs of the helix antenna. Additionally, the duration for which the metal (copper) layer 2 is etched by the laser etching system is lengthy. Furthermore, as errors occur during etching of the metal (copper) layer 2 with the specific profile by the laser etching system, the helix antenna must be fine tuned by the test and adjustment device and laser etching system. Namely, the metal (copper) layer 2 on the top of the solid ceramic cylinder 1 is etched and the openings 21 are formed thereon. Accordingly, the process of fine tuning the helix antenna increases manufacturing time and costs thereof.

Hence, there is a need for a helix antenna with reduced manufacturing costs and simplified structure.

SUMMARY OF THE INVENTION

Accordingly, an exemplary embodiment of the invention provides an antenna device comprising a dielectric body and a flexible printed circuit board. The dielectric body comprises a concave surface and a convex surface and the flexible printed circuit board is disposed on the convex surface.

The dielectric body comprises a cylinder having a through hole therein and the convex surface comprises the circumferential surface of the cylinder and the concave surface comprises an inner surface of the cylinder surrounding the through hole.

The flexible printed circuit board is swirled and attached to the circumferential surface of the cylinder, wherein a metal feeding strip and a metal grounding strip extend from the flexible printed circuit board and passing through the through hole.

Furthermore, the flexible printed circuit board further comprises at least one first metal strip and at least one second metal strip parallel thereto, and the first and second metal strips tilt to one side of the flexible printed circuit board at a predetermined angle, wherein the metal feeding strip is connected to the first metal strip and the metal grounding strip is connected to the second metal strip.

The flexible printed circuit board provides a specific value of impedance matching, whereas the dielectric body comprises ceramic material.

BRIEF DESCRIPTION OF THE DRAWINGS

The present invention will become more fully understood from the subsequent detailed description and the accompanying drawings, which are given by way of illustration only, and thus are not limitative of the present invention and wherein.

DETAILED DESCRIPTION OF THE PREFERRED EMBODIMENTS

Figure 2A:
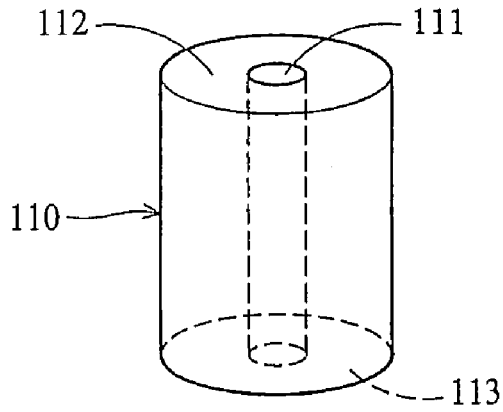
FIG. 2A is a schematic perspective view of the ceramic cylinder of helix antenna of an embodiment of the invention.

Referring to FIG. 2A, a ceramic cylinder 110 is provided. The ceramic cylinder 110 comprises a central through hole 111, a first annular surface 112, and a second annular surface 113. The first annular surface 112 is opposite the second annular surface 113. The central through hole 111 is between the first annular surface 112 and the second annular surface 113.

Figure 2B:
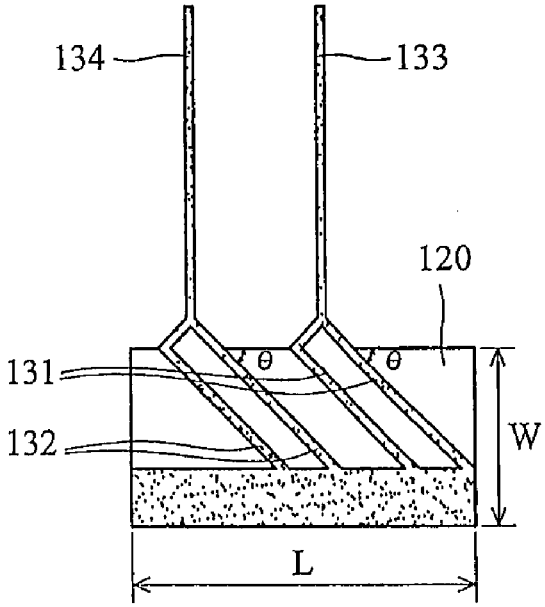
FIG. 2B is a schematic plane view of the flexible printed circuit board of helix antenna of an embodiment of the invention.

Referring to FIG. 2B, a flexible printed circuit board (FPCB) 120, the parameters of which are finely tuned, is provided. Namely, some parameters, such as radio frequency (RF) and impedance matching, are finely tuned in the flexible printed circuit board 120. In this embodiment, the impedance matching of the flexible printed circuit board 120 is 50Ω when the receiving frequency is 1575.42 MHz.

As shown in FIG. 2B, the length L of the flexible printed circuit board 120 equals the circumference of the ceramic cylinder 110, first annular surface 112, or second annular surface 113. The width W of the flexible printed circuit board 120 equals the height of the ceramic cylinder 110.

The flexible printed circuit board 120 comprises two first metal strips 131, two second metal strips 132, a metal feeding strip 133, and a metal grounding strip 134. The first metal strips 131 are parallel to the second metal strips 132. Specifically, the first metal strips 131 and second metal strips 132 tilt to one side of the flexible printed circuit board 120 at a predetermined angle θ. The metal feeding strip 133 is connected to the first metal strips 131 and extends outside the flexible printed circuit board 120. The metal grounding strip 134 is connected to the second metal strips 132 and extends outside the flexible printed circuit board 120.

Figure 3:
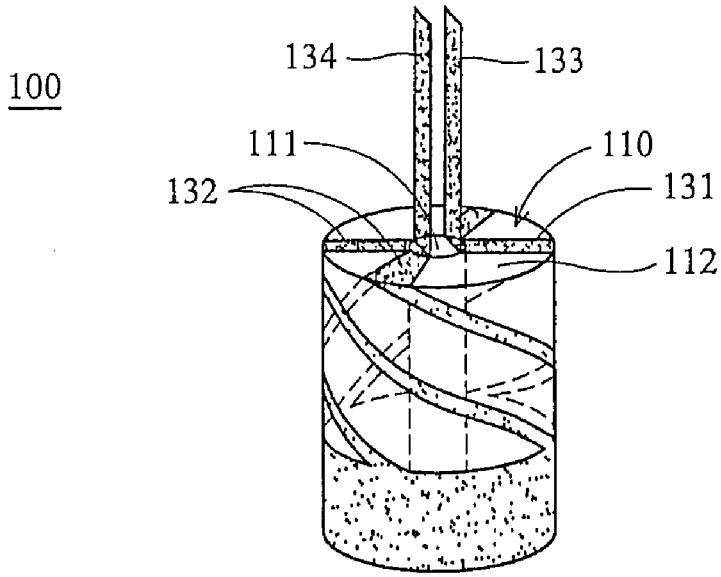
FIG. 3 is a schematic view showing assembly of helix antenna of an embodiment of the invention.
Figure 4:
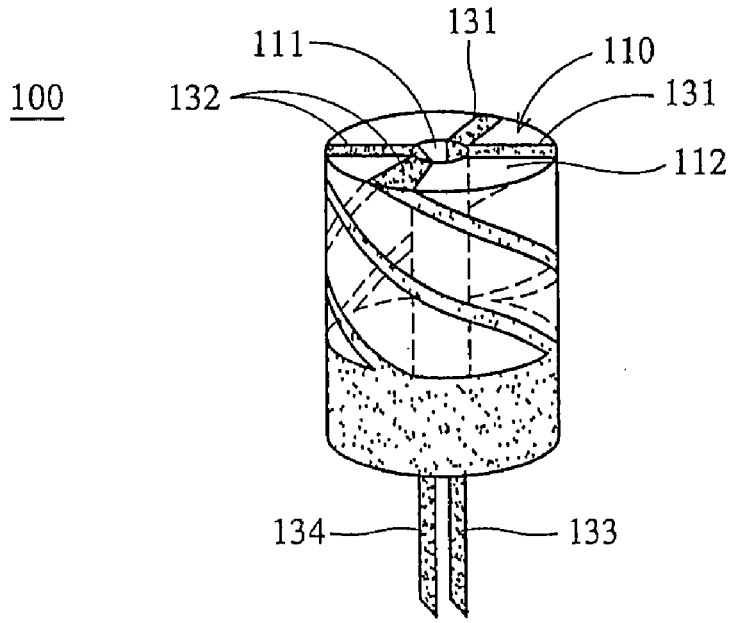
FIG. 4 is a schematic perspective view of helix antenna of an embodiment of the invention.

Referring to FIG. 3, the flexible printed circuit board 120 is swirled and attached to the circumferential surface of the ceramic cylinder 110. At this point, the metal feeding strip 133 and metal grounding strip 134 are above the first annular surface 112 of the ceramic cylinder 110. As shown in FIG. 2A and FIG. 4, the metal feeding strip 133 and metal grounding strip 134 pass through the central through hole 111 from the first annular surface 112 to the second annular surface 113. At this point, assembly of a helix antenna 100 is complete. Specifically, as tilting to one side of the flexible printed circuit board 120 at a predetermined angle θ, the first metal strips 131 and second metal strips 132 helically surround the ceramic cylinder 110 after the flexible printed circuit board 120 is swirled and attached to the circumferential surface of the ceramic cylinder 110.

Additionally, the first metal strips 131 and second metal strips 132 can be electroplated or printed on the flexible printed circuit board 120. Alternatively, the flexible printed circuit board 120 can be formed by electroplating or printing the first metal strips 131 and second metal strips 132 on a substrate.

Figure 1A:
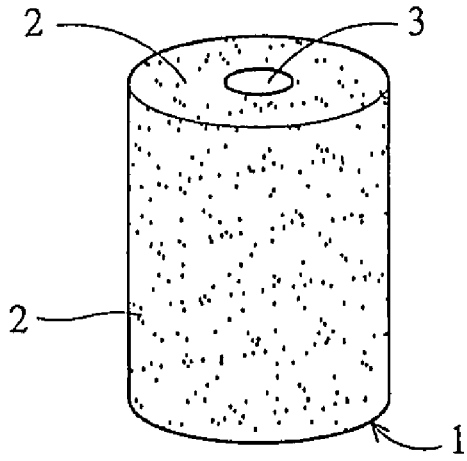
FIG. 1A ( RELATED ART )
FIG. 1A is a schematic perspective view showing the manufacturing process of a conventional helix antenna.
Figure 1B:
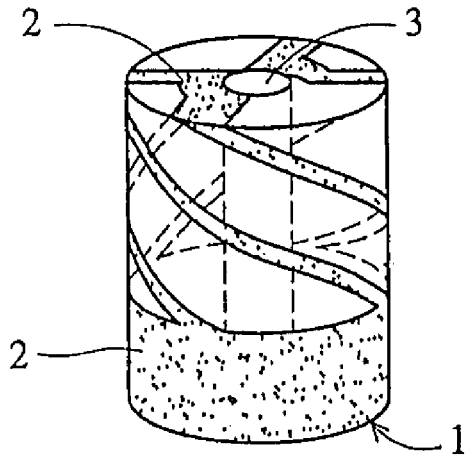
FIG. 1B ( RELATED ART )
FIG. 1B is a schematic perspective view showing the manufacturing process of the conventional helix antenna of FIG. 1A.
Figure 1C:
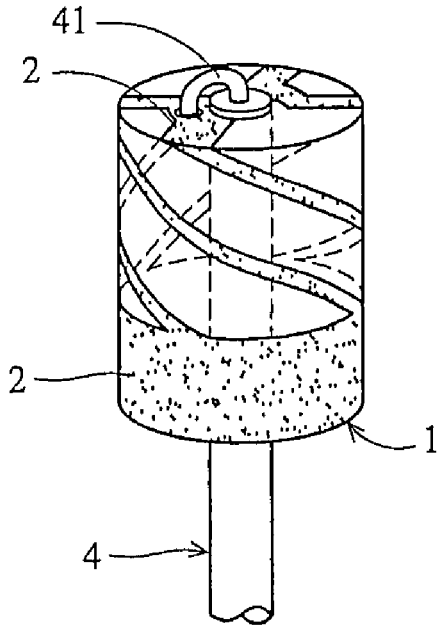
FIG. 1C ( RELATED ART )
FIG. 1C is a schematic perspective view showing the manufacturing process of the conventional helix antenna of FIG. 1B.
Figure 1D:
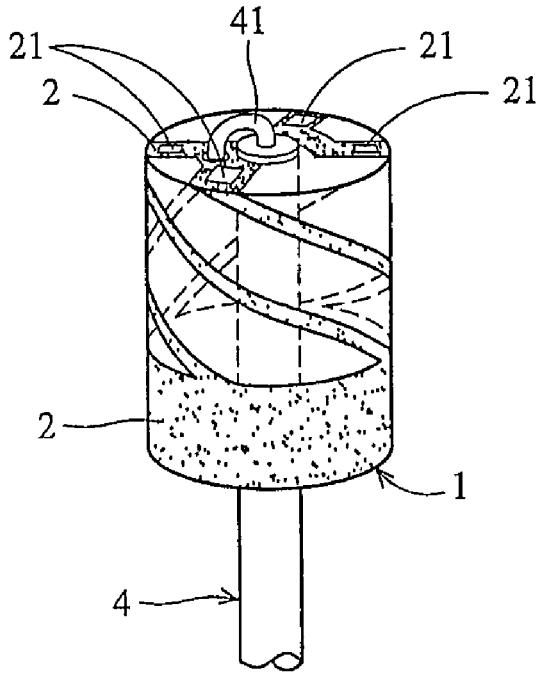
FIG. 1D ( RELATED ART )
FIG. 1D is a schematic perspective view showing the manufacturing process of the conventional helix antenna of FIG. 1C.

In conclusion, the disclosed method for manufacturing the helix antenna 100 has the following advantages. The disclosed method does not require the process of bending and welding the copper core 41 to the metal (copper) layer 2 on the top of the solid ceramic cylinder 1, as shown in FIG. 1C and FIG. 1D, thus reducing manufacturing time and complexity. Moreover, the laser etching system and test and adjustment device are not required, such that manufacturing costs of the helix antenna 100 are reduced. Additionally, as important parameters in the flexible printed circuit board 120 are finely tuned before the flexible printed circuit board 120 is swirled and attached to the circumferential surface of the ceramic cylinder 110, fine-tuning operation of the parameters performed by the laser etching system and test and adjustment device is not required, further reducing the manufacturing costs and time of the helix antenna 100. Furthermore, as unity exists in the flexible printed circuit board(s) 120, mass production of the helix antenna 100 is available, thereby enhancing productivity.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An antenna device, comprising:

a dielectric body having a convex surface and a concave surface, wherein the dielectric body is a cylinder with a through hole, the convex surface comprises the circumferential surface of the cylinder, and the concave surface comprises an inner surface of the cylinder surrounding the through hole;

a flexible printed circuit board disposed on the convex surface; and a metal feeding strip extending from the flexible printed circuit board and passing through the through hole.

2. The antenna device as claimed in claim 1, wherein the cylinder comprises a first annular surface and a second annular surface with the through hole therebetween, and the metal feeding strip passes through the through hole from the first annular surface to the second annular surface.

3. The antenna device as claimed in claim 1, wherein the flexible printed circuit board is swirled and attached to the circumferential surface of the cylinder.

4. The antenna device as claimed in claim 1, further comprising a metal grounding strip extending from the flexible printed circuit board and passing through the through hole.

5. The antenna device as claimed in claim 4, wherein the metal grounding strip passes through the through hole from the first annular surface to the second annular surface.

6. The antenna device as claimed in claim 4, wherein the flexible printed circuit board further comprises at least one first metal strip and at least one second metal strip parallel thereto, and the first and second metal strips tilt to one side of the flexible printed circuit board at a predetermined angle, wherein the metal feeding strip is connected to the first metal strip and the metal grounding strip is connected to the second metal strip.

7. The antenna device as claimed in claim 6, wherein the first and second metal strips are electroplated on the flexible printed circuit board.

8. The antenna device as claimed in claim 6, wherein the first and second metal strips are printed on the flexible printed circuit board.

9. The antenna device as claimed in claim 1, wherein the length of the flexible printed circuit board equals the circumference of the cylinder and the width of the flexible printed circuit board equals the height of the cylinder.

10. The antenna device as claimed in claim 1, wherein the flexible printed circuit board provides a specific value of impedance matching.

11. The antenna device as claimed in claim 1, wherein the dielectric body comprises ceramic material.

12. An antenna device, comprising:

a ceramic body having a convex surface and a concave surface, wherein the ceramic body is a cylinder with a through hole, the convex surface comprises the circumferential surface of the cylinder, and the concave surface comprises an inner surface of the cylinder surrounding the though hole;

a flexible printed circuit board disposed on the convex surface of the ceramic body; and a metal feeding strip extending from the flexible printed circuit board and passing though the through hole.

13. The antenna device as claimed in claim 12, wherein the flexible printed circuit board is swirled and attached to the circumferential surface of the cylinder.

14. The antenna device as claimed in claim 12, further comprising a metal grounding strip extending from the flexible printed circuit board and passing through the through hole.

15. The antenna device as claimed in claim 14, wherein the flexible printed circuit board further comprises at least one first metal strip and at least one second metal strip parallel thereto, and the first and second metal strips tilt to one side of the flexible printed circuit board at a predetermined angle, wherein the metal feeding strip is connected to the first metal strip and the metal grounding strip is connected to the second metal strip.

16. The antenna device as claimed in claim 12, wherein the flexible printed circuit board provides a specific value of impedance matching.

* * * * *